United States Patent [19]

Ahmed

[11] 4,306,610

[45] Dec. 22, 1981

[54] METHOD OF CONTROLLING CONTINUOUS CASTING RATE

[75] Inventor: Aziz Ahmed, Charlotte, N.C.

[73] Assignee: Korf Technologies, Inc., Charlotte, N.C.

[21] Appl. No.: 81,715

[22] Filed: Oct. 3, 1979

[51] Int. Cl.[3] ..... B22D 11/16

[52] U.S. Cl. ..... 164/4.1; 164/155; 164/420

[58] Field of Search ..... 164/4, 154, 155, 413, 164/420

[56] References Cited

U.S. PATENT DOCUMENTS

| | | | |
|---|---|---|---|
| 3,358,743 | 12/1967 | Adams | 164/413 X |
| 3,521,696 | 7/1970 | Lowman et al. | 164/420 X |
| 3,537,505 | 11/1970 | Thalmann et al. | 164/4 |
| 3,817,311 | 6/1974 | Pellinat | 164/4 |

FOREIGN PATENT DOCUMENTS

| | | | |
|---|---|---|---|
| 1291862 | 4/1969 | Fed. Rep. of Germany | 164/154 |
| 1813330 | 8/1970 | Fed. Rep. of Germany | 164/4 |
| 648332 | 2/1979 | U.S.S.R. | 164/154 |

*Primary Examiner*—Robert D. Baldwin
*Assistant Examiner*—J. Reed Batten, Jr.
*Attorney, Agent, or Firm*—Ralph H. Dougherty

[57] ABSTRACT

A method for controlling the casting rate in the continuous casting of liquid metals by monitoring the casting temperature downstream from the continuous casting mold and opening or closing the bottom-pour nozzles on the hot metal vessels when the casting temperature at such point deviates from a preselected temperature range. The method includes switching of the control strand in multiple strand casters whenever the control strand has some difficulty.

2 Claims, 2 Drawing Figures

METHOD OF CONTROLLING CONTINUOUS CASTING RATE

BACKGROUND OF THE INVENTION

This invention relates to the continuous casting of liquid metals and is especially useful in the continuous casting of steel.

Continuous casting has been a commercial success in the world for about two decades, enjoying both technical and economic advantages over ingot casting. Continuous casting is extremely well suited for computerized control. However, previous attempts at computerized control have been complex and expensive, such as is taught in Adams U.S. Pat. No. 3,358,743 assigned on its face to Bunker Ramo.

In the continuous casting of steel a furnace is tapped into a refractory lined ladle equipped with a bottom pour mechanism such as a stopper rod as shown in Bruderer et al U.S. Pat. No. 3,946,795 or a slide gate system as shown in Shapland U.S. Pat. No. 3,352,465. The hot metal is poured from the ladle into an intermediate pouring vessel known as a tundish, which is equipped with one or more bottom pour nozzles, depending on the number of casting strands or pouring streams desired. Usually each nozzle is located above a continuous casting mold, although with a very wide mold, such as is used in a slab caster, two or more pouring streams may deliver molten metal to a single casting mold. Each mold is open ended and has water cooled mold walls.

Both the ladle and the tundish may be equipped with a slide gate pouring system or a stopper rod pouring system or a combination. However, this invention is principally intended for use in a continuous casting system where the ladle only is equipped with nozzle control including a slide gate closure member or a stopper rod closure member, and the tundish outlet is plugged with asbestos or some other convenient plug system which is pulled from the bottom to initiate pouring into a continuous casting mold. In practice a molten steel filled ladle is positioned with the nozzle above the tundish. The nozzle is opened on the ladle to permit steel flow into the tundish. After molten steel has reached a predetermined level, the tundish nozzle or nozzles are opened, allowing the steel to teem into the mold. The mold is temporarily closed at its bottom with a dummy bar head including a chill plate and chill pins and/or scrap, which, along with the water cooling of the mold, causes the steel to become partially solidified along the mold sidewalls and the bottom of the casting. The casting removal system is then actuated to withdraw the dummy bar. As the casting, which is now connected to the dummy bar, leaves the mold, it is supported by slide plates or rolls and guides. Water sprays are directed onto its surface to increase the solidification of the casting skin. Usually a casting follows a curved path, after which it passes through straightening rolls. By the time the casting reaches the straightening rolls, it either has only a very small liquid core or is totally solidified. Excessively hot steel in the mold and insufficient cooling in and beneath the mold can cause re-melting of the solidified skin, resulting in a break out.

The flow of the steel into the mold is principally controlled by the cross-sectional area of the tundish nozzle, and to a small extent, by the ferrostatic head or steel height in the tundish. Since the depth of the tundish is a known factor, and the nozzle sizes are known, the casting rate thus varies in a predetermined range. Casting speed heretofore has been subject to variation because the height of the molten metal in the tundish varies during the pouring of a heat, and because the ladle and tundish nozzle areas increase due to erosion caused by the flow of steel through the nozzles. Therefor, controlling the flow rate within a portion of this range will insure that the caster is operated at a higher casting rate at the usual break out rate or at a usual casting speed at a reduced break out rate.

OBJECTS OF THE INVENTION

It is the principal object of this invention to provide a method for controlling the casting speed of a continuous casting machine.

It is another object of this invention to provide a method for controlling the casting speed of a continuous casting machine at normal break out rate and increased casting speed, or at normal casting speed with reduced break out rate.

It is also an object of this invention to provide a method for controlling the casting speed of a continuous casting machine which will improve productivity, operational consistency, and machine availability.

It is a further object of this invention to provide a method for controlling casting speed of a continuous casting machine by monitoring the surface temperature of the casting at a point downstream from the casting mold and opening or closing the ladle nozzle in response to a signal generated by the temperature measurement.

SUMMARY OF THE INVENTION

These and other objects are achieved by continuously monitoring the surface temperature of the casting at a preselected location remote from and downstream from the mold, generating a signal when the temperature of the casting deviates from a preselected temperature range and controlling the ladle pouring rate in response to the signal whereby the pouring rate decreases when the surface temperature of the casting increases and the pouring rate increases when the surface temperature of the casting decreases beyond the preselected temperature range.

BRIEF DESCRIPTION OF THE DRAWINGS

The invention is more readily understood by referring to the following detailed specification and the appended drawings in which.

DETAILED DESCRIPTION

Figure 1:
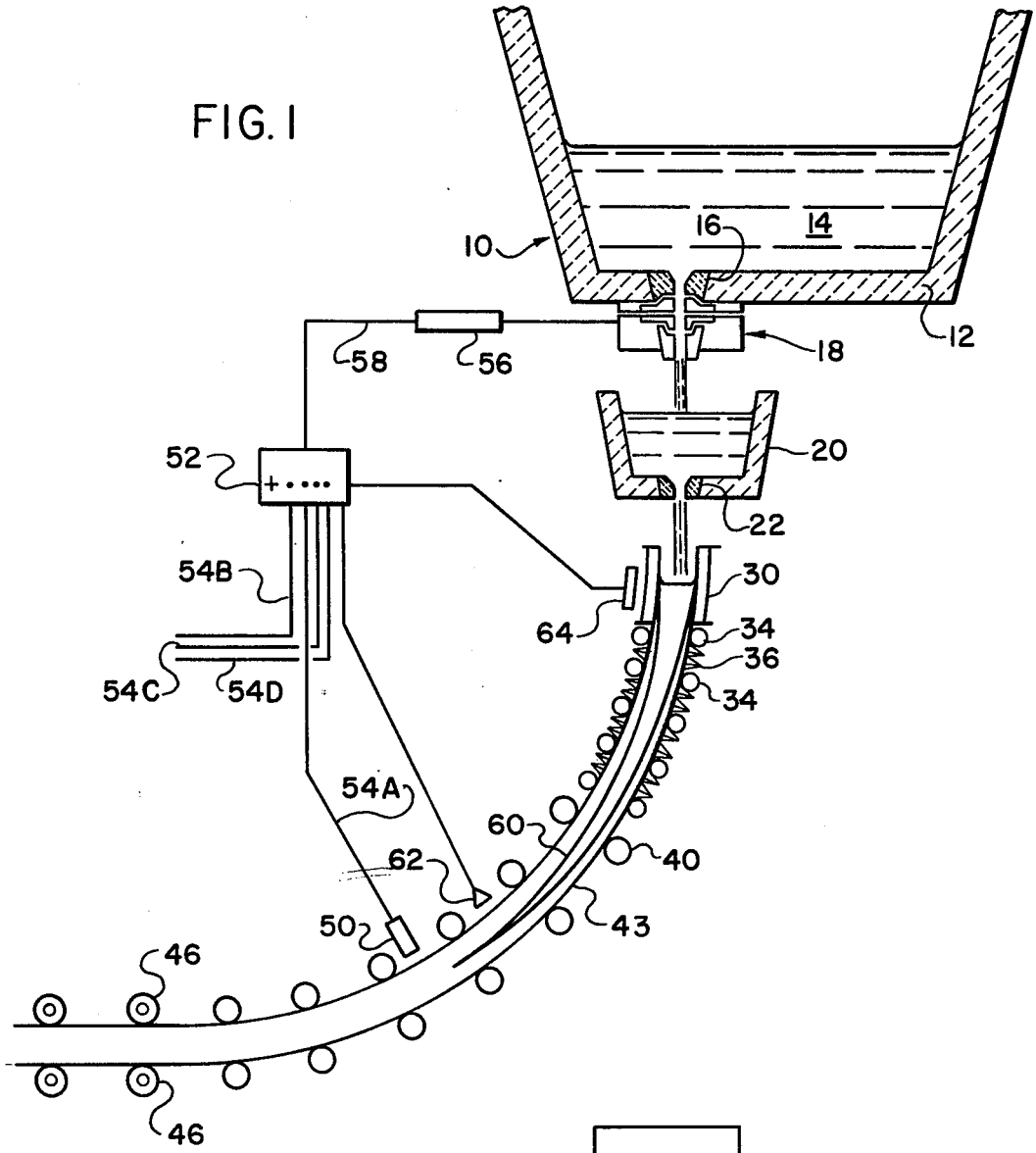
FIG. 1 is a schematic elevational view in cross section of a continuous casting machine, tundish, ladle, and the necessary equipment for carrying out the method of the invention.

Referring now to FIG. 1, a hot metal ladle 10 lined with refractory 12 and containing molten steel 14 has a bottom pour nozzle 16, which is controlled by a slide gate system 18 (or stopper rod system). The ladle is positioned with its pouring nozzle above an intermediate pouring vessel or tundish 20 which is refractory lined or lined with insulating boards and has one or more pouring nozzles 22 in its bottom wall. The tundish is positioned above an open ended, continuous casting mold 30 which is vertically oscillatible and may have straight walls or curved walls as shown.

Beneath the mold are a series of support and guide rolls 34 and interspersed water cooling sprays 36. Further downstream are support and guide rolls 40 which guide the casting 43 around a curve and feed it into straightening rolls 46. Beyond the straightening rolls is a cutting device not shown.

A temperature measuring device 50 is mounted downstream from the sprays 36 to continuously measure the surface temperature of the casting 43. The device 50 can be any suitable temperature monitoring device such as a thermo-element, pyrometer or the like. The signal generated by the device 50 is relayed to a control unit 52 via connection line 54A. So long as the temperature at the measuring point remains in a predetermined range, control unit 52 does not react.

Controller 52 is connected to ladle slide gate control 56 through line 58. The nozzle control is any suitable slide gate control such as a hydraulic or pneumatic unit or a mechanical unit with a motor drive.

In operation, the ladle 10 is filled with molten steel and moved into pouring position above tundish 20. The pouring nozzle is opened and the steel flows into the tundish. When the liquid level is sufficiently high in the tundish, the tundish nozzle is opened and the steel is poured into the mold. After a sufficient period of time for the casting to form a solidified skin the dummy bar and casting are withdrawn downward. The cooling effect of the mold and the water sprays 36 in the spray chamber causes the solidified skin thickness of the casting 43 to increase. As the casting moves downward the liquid core 60 of the casting continues to solidify until the casting cross-section is completely solid. Temperature measuring device 50 continuously measures the temperature of the casting at a selected point remote from and downstream from the mold. This point must be sufficiently far downstream from the mold that the cooling water from sprays 36 or water vapor will not interfere with the temperature reading. The device 50 generates a signal which is fed to adjustable controller 52 which is preset to a predetermined acceptable temperature range for the casting. When the signal from device 50 indicates to the controller that the temperature is outside the predetermined range the controller signals slide gate control 56 to open or close as necessary. At any time when the temperature of the casting is detected to fall beneath the range, the nozzle opening is increased. Conversely, at any time the temperature of the casting rises above the upper limit of the preset range, the nozzle opening is throttled back, decreasing the steel flow to the mold.

A temperature measuring device 50 is installed on each strand of the casting machine. That is, on a four strand machine, four such devices will be installed. Each is connected to controller 52 by line 54A, 54B, 54C or 54D. During operation, only one selected device has a signal input to the control unit. In case casting is terminated on the strand on which the controlling temperature measuring device is located, control unit 52 is switched to one of the remaining units as the signal generating device. This may be done manually or automatically. The same occurs if any strand is lost due to break out or other problem. At any time a casting strand is stopped, for instance if the casting is stuck at the shears, casting travel detector 62 generates a signal to control unit 52. If this particular strand is the one being temperature monitored the control unit 52 will switch to another strand in response to detector 62.

If there is a break out or a nozzle freeze-up, the liquid level in the mold 30 will drop drastically, but the casting 43 will continue to move. In this case, a steel presence indicating device 64 generates a signal to control unit 52, which will switch to another strand in response to this signal. Alternatively a mold level control device can generate this signal for the control unit.

Figure 2:
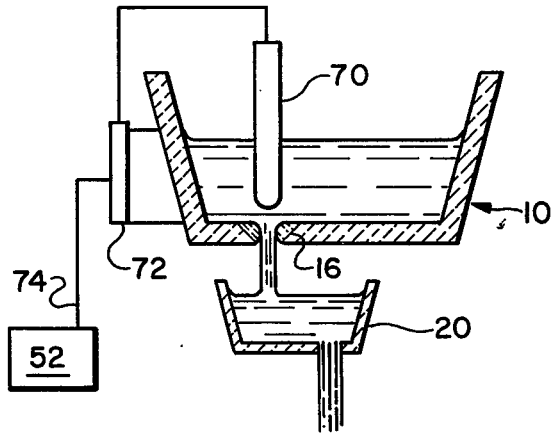
FIG. 2 is a schematic elevational view in cross section of a ladle having a stopper-rod nozzle closure controlled in accordance with the present invention.

FIG. 2 shows an alternative embodiment of the present invention whereby ladle 10 is provided with a bottom pour nozzle 16 and a stopper rod 70. The stopper rod 70 has a lifting and lowering mechanism 72 which is mounted on the ladle and is connected to controller 52 by signal line 74. In all other regards, this system is the same as in FIG. 1.

From the foregoing, it is readily apparent that I have invented a casting speed control for continuous casting of hot metal from bottom-pour vessels, which will result in higher casting speed and higher production rate than have been heretofore possible.

What is claimed is:

1. A method for controlling the casting rate of molten metal from a bottom-pour vessel into an open-ended continuous casting mold beneath and spaced from said bottom-pour vessel and from the bottom of which mold a casting is withdrawn and cooled by water sprays, said bottom-pour vessel having a nozzle in its bottom wall and a flow control means for controlling the flow rate of molten metal through said nozzle, said method comprising:

(a) continuously measuring only the surface temperature of the casting at a preselected location remote from and downstream from said mold and downstream from said water sprays:

(b) comparing the temperature measurement to a predetermined temperature range;

(c) generating a signal when said temperature measurement deviates from said predetermined temperature range, said signal being indicative of the deviation from said temperature range; and (d) said signal generating only an adjustment to said flow control means to maintain metal flow into said mold at such a rate that solidification of the casting proceeds at a sufficient rate to maintain the downstream temperature of the casting at said preselected location within said preselected temperature range.

2. A method according to claim 1 wherein said metal is first poured from said bottom-pour vessel into an intermediate pouring vessel and thence into said mold.

* * * * *